United States Patent [19]

Maeder

[11] 4,148,208

[45] Apr. 10, 1979

[54] METHOD AND APPARATUS FOR IRONING CONTAINERS

[75] Inventor: Edward G. Maeder, Minnetonka, Minn.

[73] Assignee: National Can Corporation, Chicago, Ill.

[21] Appl. No.: 840,519

[22] Filed: Oct. 11, 1977

[51] Int. Cl.[2] ..... B21D 22/20

[52] U.S. Cl. ..... 72/342; 72/347; 113/120 H

[58] Field of Search ..... 72/45, 342, 347, 349, 72/467; 113/120 A, 120 H

[56] References Cited

U.S. PATENT DOCUMENTS

| | | | |
|---|---|---|---|
| 3,577,753 | 5/1971 | Shah | 72/342 |
| 3,735,629 | 5/1973 | Paramonoff | 113/120 H |

*Primary Examiner*—Lowell A. Larson

*Attorney, Agent, or Firm*—Robert A. Stenzel; Ralph R. Rath

[57] ABSTRACT

A process and apparatus for making a drawn and ironed container from a circular blank is disclosed herein. The process contemplates flowing a fluid medium through the punch of a drawing and ironing machine and maintaining the fluid medium at a predetermined temperature above the initial ambient temperature of a cup that is converted into a drawn and ironed container. The process also includes cooling the ironing dies by flowing a liquid through grooves located in the rings of the dies and the rings are made of tungsten carbide. The grooves in the ironing dies are non-radial with respect to the center of the opening in the ring so that the fluid has a tangential component of flow and flows in a generally circular pattern within the peripheral confines of the die opening.

24 Claims, 7 Drawing Figures

36
42
12
30
10
100
24
22
20
14
24
90
22
20
38
92
26

48
46
44
36
56
40
32
42
12
54
52
30
50
51
49
38
34

METHOD AND APPARATUS FOR IRONING CONTAINERS

BACKGROUND OF THE INVENTION

The present invention relates generally to drawn and ironed containers and more particularly to a process and apparatus for manufacturing such containers. While the disclosure is specifically described in connection with making beer and/or beverage containers, it will have applicability in other drawing and ironing processes.

The drawing and ironing process for making thin walled containers that have a cylindrical sidewall and a unitary or integral end wall has been used in the container manufacturing industry for several years. The most common process utilized in manufacturing containers, particularly containers that are utilized for packaging beer and/or carbonated beverages consists of cutting a disc of predetermined diameter and substantially simultaneously converting the disc into a cup. The cup is then fed into a special press which is generally referred to as a drawing and ironing press or body maker, wherein the cup is initially redrawn to a smaller diameter, the final diameter of the inside of the container, and the wall thickness of the redrawn cup is then reduced through ironing dies or rings that cooperate with a punch that moves the cup through the iron rings. This process is described in detail in an article appearing in the November, 1973 *Aerosol Aid Magazine* entitled the "Drawn and Ironed Can, Understanding the Technology" by Edward G. Maeder.

In another well known process for making thin walled containers, the disc is initially converted into a cup having an internal diameter equal to the finished container and the side wall thickness of the cup is reduced through ironing rings that cooperate with a punch in a manner similar to that discussed above.

For many years most of the drawn and ironed containers were formed from aluminum. Quite recently, tinplate, which consists of black plate that is coated on both surfaces with a thin layer of tin, has become an acceptable alternate for aluminum in making drawn and ironed containers. While tinplate has been found to be an acceptable substitute and competitive alternate for aluminum, the availability of the tin for this material is limited. Furthermore, manufacturers are constantly striving to reduce the costs of making containers. Thus, recent attempts have been made to form drawn and ironed containers from black plate without the use of the tin coatings thereon.

One problem that has been a significant factor in successfully making drawn and ironed containers, particularly from tinplate or black plate, is stripping the finished container off the punch. Stripping problems relate primarily to shrinking of the container on the punch after the last ironing step and before stripping actually takes place which results in large frictional forces between the punch and the container. Stripping problems are most acute where the temperature gradient between the punch and container is high such as when an operation is initiated with ambient temperature tooling. Thus, many containers must be discarded because they are damaged during stripping. In some instances, during start-up, the containers are not acceptable because they are too short, which results from the wall thickness being too thick due to the cold tooling.

Another of the difficulties that have been encountered in making drawn and ironed black plate containers is that the container tends to seize to the ironing dies during the ironing process. Seizing of the container to the die has been determined to be a function of the pressure and temperature created during plastic deformation of the wall as well as the type of tool material and container material. The pressures required to reduce the wall thickness are determined by the material being used to form the container. Thus, the only parameter that can be controlled is temperature, as the plastic deformation occurs.

In order to reduce the temperature of the container and the tooling during the drawing and ironing process, it has been customary to flow a coolant, which also contains a lubricant, to the surface of the container during the ironing process. Attempts have been made to develop an ideal temperature for the coolant-lubricant.

Attempts have also been made to develop lubricants that can withstand the high pressures and temperatures involved in the drawing and ironing process. One of the problems encountered in developing such lubricants is to maintain the lubricants in the interface between the cup and the ironing dies at the entrance to the die. Heretofore, only coatings, such as organic coatings, phosphates and tin, have been found to have enough viscosity to withstand the shear required to enter the interface between the die and the cup and act as an effective lubricant.

SUMMARY OF THE INVENTION

It has now been determined that stripping problems for containers formed from either tinplate or black plate can be substantially reduced by maintaining the punch at a predetermined temperature above the ambient temperature of the cup entering a drawing and ironing machine, particularly when the process is being initiated.

More specifically, the method of the present invention contemplates an ironing process for making ironed containers from a circular metal blank by converting the blanks into cups, placing the cups on a punch axially aligned with dies and moving the punch and dies relative to each other to reduce the wall thickness of the sidewall of the cup and produce the ironed container. During such ironing of the container wall, a fluid medium is flowed through the punch and the fluid medium is maintained at a predetermined temperature above the initial ambient temperature of the cup as it enters the ironing machine.

It has been determined that this particular process will reduce the temperature gradient between the container and the punch during the last ironing step which minimizes shrinking of the container on the punch thereby reducing the force required for stripping the container from the punch. The most significant aspect of maintaining this predetermined temperature is that a steady state condition for the process can be achieved in a very short period of time. The primary factor in achieving steady state is to insure that the first container can be stripped from the punch satisfactorily. Otherwise, it is very troublesome to initiate the process.

The efficiency of the process is further increased by maximizing the cooling of the ironing dies during the ironing process. This is accomplished by maximizing the surface area of the tungsten carbide insert of the dies that is exposed to the cooling fluid.

More specifically, each tungsten carbide insert or ring for the ironing die includes an annular body having a substantially circular opening with leading and trailing surfaces extending substantially perpendicular to the axis of the circular opening. The leading and trailing surfaces each have a plurality of grooves extending from the periphery of the body to the center opening for receiving a liquid to transfer heat from the body to the liquid during the ironing process.

In the specific form of ironing ring, the respective grooves are arcuate and intersect the inner edge of the member at an angle to a radial plane for said opening. The arcuate grooves have their centers laterally offset from the center of the opening so that the flow through the grooves is close to being tangential to the inner edge of the ironing ring. Also, the respective grooves on opposite surfaces are interconnected along a further groove that interconnects a pair of circumferentially spaced grooves on the leading and trailing surfaces respectively. This arrangement allows for fluid to be forced into each set of three interconnected grooves at one corner of the die member so that the fluid will flow in both directions through the respective grooves.

The large surface area of the tungsten carbide insert, which has a high degree of thermal conductivity, will maximize the heat transfer from the die to the cooling fluid. In this fashion, heat is removed in the most effective manner from the most critical area, the die-metal interface.

DETAILED DESCRIPTION

Figure 1:
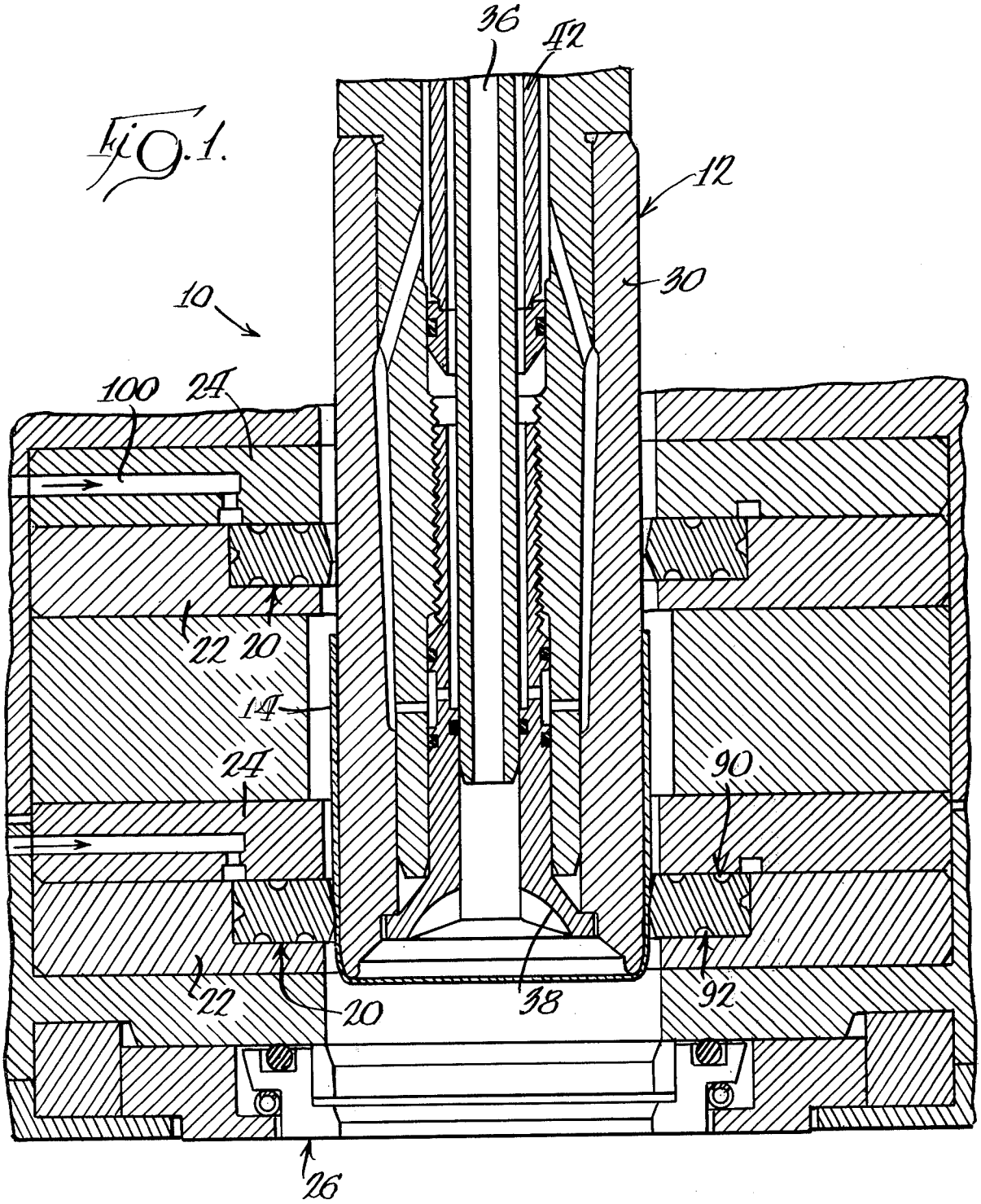
FIG. 1 shows a fragmentary sectional view of the various parts of an ironing machine.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings generally illustrates the ironing portion of a drawing and ironing machine or body maker 10 for drawing and ironing a cup into a container. The term "cup" as used throughout the specification and in the claims is considered to be the body of the container at all stages until a finished container has been formed. Drawing and ironing machine 10 consists of a punch assembly 12 which receives a cup 14 that conforms to the periphery of the punch. The cup can be redrawn to the diameter of the punch by using a redraw mechanism that is part of the body maker or the cup can initially be formed to the diameter of the punch. The cup is forced through two or more ironing dies that each include a ring or insert 20 supported between plates or members 22 and 24. The details of the ironing dies 20 will be described in more detail hereafter. The finished containers are then stripped from punch assembly 12 through a stripper mechanism 26 of the type that is well known in the art.

Before considering the details of the invention, a brief summary of the present problems that have been encountered during the drawing and ironing of a container appears to be in order. As is well known, the entire mechanical energy input required for plastic deformation of the sidewall of a container is present after the deformation in the form of heat energy. The most important areas where this heat energy or maximum temperature occurs are the interface between the die and container and the interface between the container and the punch. This is the area where actual deformation takes place and the high temperatures combined with the high localized pressure can cause seizing, galling, metal pickup, etc., on the die ring.

Furthermore, as the process continues, the retained heat in the dies increases to some unknown value, which will be dependent upon the time of operation. For example, when a press is started up, the punch and dies are at ambient temperature and a number of containers must be made before the can height appears to be proper. This is believed to result from the fact that heat is delivered to the punch and dies from the first few containers to bring the tools to some operating temperature parameter. During this period of time, the punch diameter and die opening may actually vary in diameter to decrease the gap between the die and the punch thereby decreasing the wall thickness and increasing the height thereof sufficient for the required purposes.

However, as the operation continues, each container will continue to transfer some of the heat thereof to the punch and the punch will soon be at a temperature above the ambient temperature of the incoming cup so that the punch is transferring heat from the body thereof to the cup as it enters the body maker. Thus, if a machine runs without interruption for many hours, withour proper application of the coolant, the process could be very hot and temperatures could be rising despite a large temperature gradient between the punch and the dies and the coolant. This means that the tools may continue to rise in temperature and may reach a critical threshold temperature for a particular metal. For example, in making drawn and ironed containers from tinplate, this threshold temperature could be assumed to be the melting temperature for the tin, which is 450 degrees F. While the parameters are not known, similar threshold temperatures also exist for black plate as well as aluminum.

Another factor alluded to above, is the wall thickness of the container. One of the significant factors in determining wall thickness is the exact tool gap, i.e., the inside diameter of the die and the outside diameter of the punch, when a container body is being made. Of course, as the temperature of the tooling increases, the tool gap decreases and, therefore, the wall thickness of the container body decreases.

Furthermore, the size of the tool gap at the last ironing stage is the most important since it generally determines the final wall thickness for the container and the wall thickness is again dependent upon the temperature of the tooling as the cup passes through the last ironing die.

According to the primary aspect of the present invention, it has been determined that initially heating the punch assembly to a certain predetermined temperature above the ambient temperature for the cup and subsequently maintaining the temperature of the punch at such predetermined temperature produces a more uniform tool gap and, therefore, wall thickness for all containers.

Figure 2:
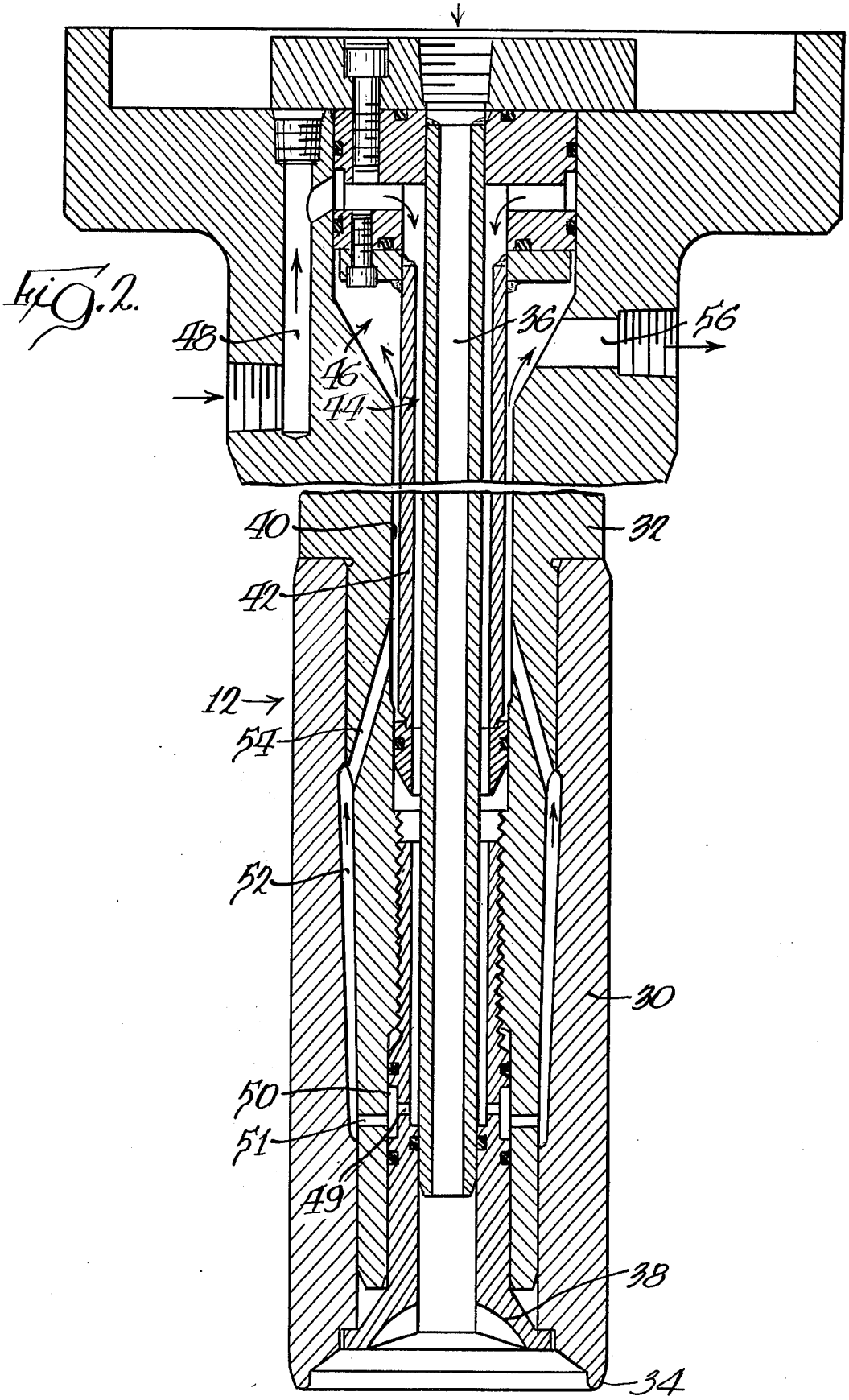
FIG. 2 is an enlarged cross-sectional view of the punch shown in FIG. 1.
Figure 3:
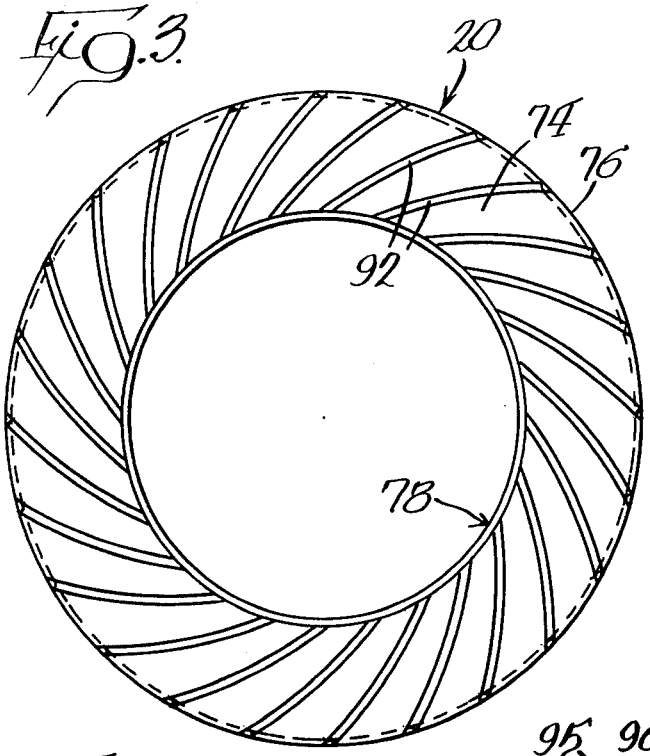
FIG. 3 is an enlarged plan view of an ironing ring insert.

The heating of the punch assembly is accomplished as illustrated in FIG. 2 wherein the punch assembly is shown in detail. Punch assembly 12 consists of a peripheral sleeve or punch 30 at the free outer end, which is made of tungsten carbide, and is supported on a central portion or ram 32 which is formed of steel. Tungsten carbide punch 30 has a preformed lower end 34 which cooperates with a doming member (not shown) for producing the final dome configuration for the end wall of the container. Sleeve 30 is held on ram or central portion 32 through an end member 38.

Punch assembly 12 also has a central tube 36 which extends the entire length thereof and is open along the center for receiving air which can be used to assist in stripping the finished container off the free end of the punch.

Ram 32 has a bore or opening 40 which extends the length thereof and is substantially larger in diameter than the peripheral diameter of tube 36. A sleeve 42 is located between tube 36 and opening 40 and is concentric with tube 36, to define two flow paths 44 and 46. Inner flow path 44 is in communication with the periphery of the ram through an opening 48 so that a source of fluid medium can be connected thereto. The other end of inner flow path 44 is in communication through bores 49 with an elongated circumferential groove 50 defined on the periphery of end member 38 which in turn is in communication through bores 51 with an annular opening 52 located between the inner surface of punch 30 and the outer surface of ram 32. This annular opening 52 is, therefore, located between the peripheral surface of ram 32 and the inner surface of punch 30. The upper end of annular opening 52 is connected to outer flow path 46 through an inclined annular opening 54. Also, the upper end of outer flow path 46 is in communication with the periphery of ram 32 through an opening 56.

According to one aspect of the present invention, a heated fluid medium, such as water, is directed through opening 48 and along inner annular flow path 44 adjacent the center of the punch assembly and flows radially outwardly through bores 49, annular groove 50 and bores 51 and then along annular opening 52 and exits through opening 56 so that the temperature of the peripheral surface of punch 30 can be controlled by the flowing fluid medium.

As indicated above, the temperature of the fluid medium or water is maintained at a temperature that is substantially higher than the initial ambient temperature for the incoming cup. For example, the ambient temperature of the cup under normal conditions may be considered to be approximately 90 degrees F. During an actual test conducted during the making of drawn and ironed containers from tinplate, the temperature of the water received through opening 48 was maintained at approximately 170 degrees F. This punch assembly was utilized with conventional dies and flowing lubricant against the peripheral surface of the containers during the drawing and ironing operation. It was found that by maintaining the temperature of the water a predetermined temperature gradient above the initial ambient temperature of the cup, consistently less force was required to strip the containers from the punch assembly after the last ironing operation resulting in minimal "rollback" of the free edge of the container. It was also determined that substantially less containers and in most instances no containers had to be wasted during start-up of the operation and this is believed to result from the fact that the punch assembly, particularly the carbide punch 30 was heated to a temperature substantially higher than the incoming ambient metal temperature of the cup.

While no specific parameters have been developed for the actual maximum temperature of the water, it is believed that the water should be at a temperature in the range of about 130 degrees F. to about 190 degrees F. for drawing and ironing tinplate containers. The exact temperature will be dependent upon the material used for the container and the punch and should be high enough so that the first container can be stripped from the punch assembly without damage to the free edge of the container. It is also believed that if this predetermined temperature is exceeded, the system might run too "hot" which would result in having the tin on the surface of the black plate melt so that the black plate metal would be exposed. This could result in the container surface losing its specular finish (being badly streaked) and produce extreme wear on the ironing dies.

In the tests discussed above, the punch was formed from a tungsten carbide having a cobalt binder in the range of 10–15% and the average grain size of the tungsten carbide was less than one micron. The ram which supported the punch was made from tool steel. Of course, it will be appreciated that the punch could be also formed from tool steel and the temperature parameters would then be different.

According to another aspect of the invention, the efficiency or scope of the entire process of forming drawn and ironed cans, can be enhanced by utilizing a special type of ironing die which will now be described.

Ironing ring insert 20 consists of a body 70 that has a flat leading surface 72 (FIG. 5) and a flat trailing surface 74 that extend substantially parallel to each other with a peripheral surface 76 interconnecting the two surfaces and extending substantially perpendicular thereto. Inner wall or bore 78 (FIG. 6) has a center flat portion 80 which defines a circular opening. Bore 78 has a slight outward taper extending towards the leading edge that defines an entrance angle which is preferably some predetermined angle, for example, 7 to 15 degrees while the area between the center flat portion or ledge 80 and the trailing surface 74 also is slightly tapered.

According to the present invention, die ring 20 is formed from tungsten carbide and has specially designed flow paths in the body thereof which are adapted to receive a lubricant coolant, as will be described later.

Figure 5:
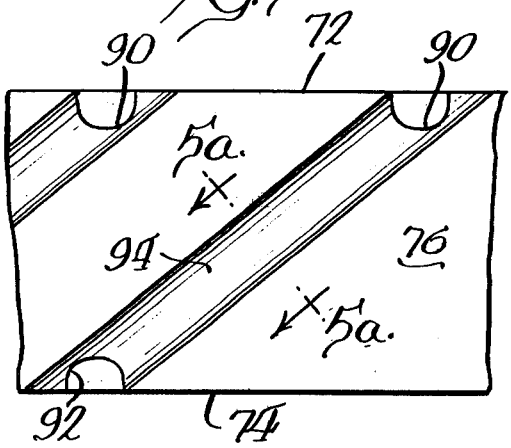
FIG. 5 is an enlarged end view of the ironing ring insert shown in FIG. 3.
Figure 6:
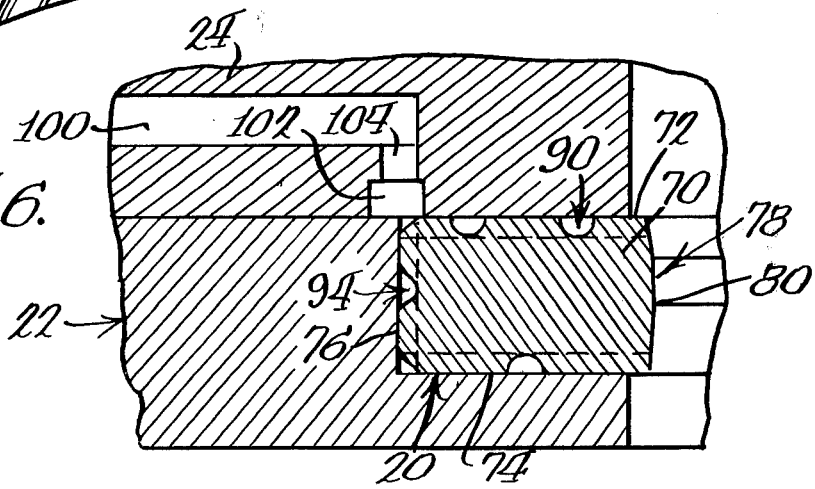
FIG. 6 is a fragmentary cross-sectional view showing the unique ironing ring or insert mounted in a support structure.

As shown in FIG. 5, leading surface 72 has a plurality of grooves 90 that extend from peripheral surface 76 and terminate at bore 78 in the center of the ring. Preferably, the grooves extend nonradially with respect to the center of bore 78 and terminate substantially tangentially to bore 78.

In the specific embodiment illustrated, each groove 90 is arcuate in plan view and has a predetermined radius which is larger than the radius of bore 78 in die ring 20. In the illustrated embodiment, twenty-four arcuate grooves are equally spaced circumferentially around leading surface 72 and all grooves convolute in the same direction. The flow paths that are defined by the respective grooves therefore terminate on the inner end of the body along a path which is substantially tangential to the periphery of the center opening in the ring and a maximum amount of tungsten carbide surface is exposed to the coolant.

Likewise, the opposite or trailing surface 74 has an equal number of grooves or recesses 92 and the adjacent grooves on the rear surface are interconnected by grooves 94 formed in the peripheral surface as illustrated in FIG. 5. The grooves 94, which are on peripheral surface 76, are preferably inclined with respect to the axis of the opening and are generally parallel so that a pair of adjacent offset or circumferentially spaced grooves 90 and 92 are interconnected to each other to define a plurality of sets of grooves, for a purpose that will be described later.

Grooves 90 and 92 are arcuate in the same direction so that the flow through these grooves is in the same direction as it enters the opening in the die ring. Also, the tangential relation of the grooves with respect to bore 78 will result in a tangential component of flow of the liquid coolant with respect to opening 78 and will produce a generally circular flow path for the coolant around the periphery of the cup that is being ironed.

Figure 5A:
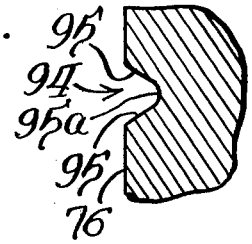
FIG. 5*a* is a fragmentary cross-sectional view, as viewed along line 5*a*—5*a* of FIG. 5.
Figure 4:
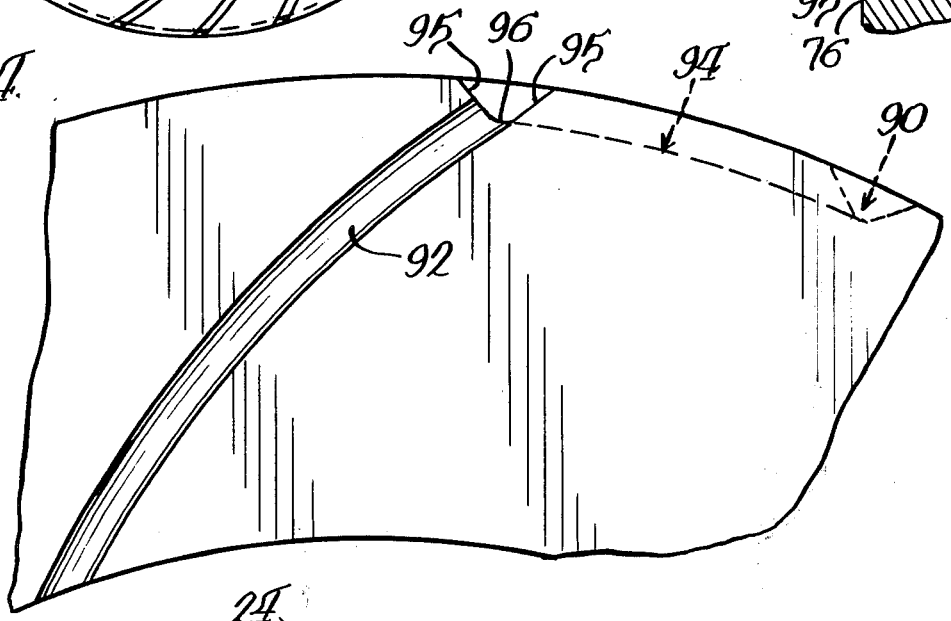
FIG. 4 is an enlarged fragmentary view of the ironing ring insert shown in FIG. 3.

While the grooves may take any number of forms, grooves 94 have been illustrated as including opposed inclined flat sidewalls 95 (FIG. 5*a*) interconnected at the base along an arcuate portion 95*a* while grooves 90 and 92 are generally U-shaped in cross section as illustrated in FIG. 5.

With the arrangement described above, all of the grooves can simultaneously have a lubricating coolant fluid supplied thereto from a single source as will now be described. Support plate or member 24 has one or more openings 100 extending from the periphery thereof which are in communication at the inner edge with an annular groove 102 through openings 104. Annular groove 102 is formed in the surface of support plate 24 which is adjacent leading surface 72 of ironing ring 20 and this groove is located at the corner or a point of intersection between all of the sets of grooves 90, 92 and 94. Therefore, all grooves 90, 92, 94 are simultaneously supplied with fluid from annular groove 102.

The advantages of utilizing the arrangement described above are numerous. Since the tungsten carbide insert is sintered, the spiral grooves can be sintered into both sides of the carbide as well as the periphery thereof at no additional cost to provide better thermal conductivity. For example, it is known that the thermal conductivity of tungsten carbide is in the range of four times the thermal conductivity of tool steel which is presently utilized to support the tungsten carbide ironing ring. Thus, placing all of the grooves in the tungsten carbide die insert will substantially increase the amount of heat that can be transferred from the carbide ring or insert 20 to the cooling medium that passes through openings 100. By having the grooves arcuate rather than radial, a maximum surface area is developed for transferring heat from the carbide die insert to the coolant fluid. Also, the arcuate grooves create a swirling effect for the coolant in the critical area of the interface between the die and container.

While the exact temperature for the coolant has not been determined, it is believed that the temperature should be maintained in the range of 70 to 100 degrees F.

For specific applications, such as black plate, it may be desirable to increase the mass of the ironing die rings beyond that which is presently being used for such rings. The increased cost for making the ring larger may be justified because it will result in increased heat transfer from the die ring to the coolant. For example, the die ring could be made several times the mass of present day conventional tungsten carbide ironing rings. While not limited to any specific grade of materials, the ironing ring is preferably formed from a tungsten carbide having 6–10% cobalt binder therein.

Utilizing separate fluid sources for the punch and the respective dies allows for individual temperature control of the respective sources of fluid. For example, while the inner fluid medium is maintained at a predetermined temperature above the ambient temperature of the incoming cups, the coolant delivered to the tungsten carbide rings or dies can actually be cooled below the ambient temperature to accommodate a maximum heat exchange between the dies which are constantly being heated by the drawing and ironing operation. Furthermore, by having the coolant material at a temperature below ambient temperature, the coolant flow across the surface of the punch, while it is being retracted during each stroke of operation, will withdraw heat from the punch to maintain the temperature of the surface of the punch within the desired limits.

Also, if the temperature of the punch exceeds the predetermined temperature of the fluid medium flowing through the punch assembly, the fluid medium will withdraw heat from the body of the assembly. The heating-cooling of the fluid medium flowing through the punch assembly could be monitored and controlled for optimizing the process, such as by controlling the temperature or flow rate of the fluid medium.

The system described above will have the intermediate shell at a lower temperature as it enters the last ironing operation, which will reduce the critical temperature gradient between the punch and the shell to enhance stripping.

Actual tests have shown that the temperature differential between the container body and the periphery of the punch after the last ironing die operation, is at a minimum when compared to differential temperatures that now exist and the temperature of the container body will remain below 400 degrees F. even if the body maker is operated for extended periods of time without interruption.

In addition, initially heating the punch before the operation, not only reduces or eliminates damaged containers but also reduces the time interval required for reaching a steady state operating condition.

It will be appreciated that, while a certain embodiment of the invention has been described, numerous modifications come to mind without departing from the spirit of the invention. For example, while the grooves on the leading and trailing surfaces of the die ring have been described as being arcuate, they could also be straight. In either case, the grooves are preferably non-radial with respect to the center of the ring. The grooves could also be formed in the support plates but this would reduce the surface area of the tungsten carbide ring which is exposed to the coolant.

Also, the coolant could be supplied separately to the grooves on the leading and trailing surfaces, respectively, in which case the grooves on the peripheral surface of the ring could be eliminated.

To further promote heat transfer from the container, the redraw ring, if used, could also have grooves on the trailing surface and the peripheral surface.

What is claimed is:

1. In an ironing process for making a drawn and ironed container from a circular metal blank by converting said blank into a cup, placing said cup on a punch axially aligned with an ironing die, and moving said punch and said ironing die relative to each other to reduce the wall thickness of the sidewall of said cup and produce an ironed container, the improvement comprising flowing a fluid medium through said punch and maintaining the fluid medium at a predetermined temperature above the initial ambient temperature of said cup to maintain said punch at a predetermined temperature.

2. An ironing process as defined in claim 1, in which said fluid medium initially heats said punch to said predetermined temperature and subsequently maintains said punch at said predetermined temperature.

3. An ironing process as defined in claim 2, including the further step of flowing a liquid across said ironing die and maintaining said liquid at a temperature to transfer heat from said die to said liquid.

4. An ironing process as defined in claim 3, in which said ironing die has grooves and said liquid is forced through said grooves.

5. An ironing process as defined in claim 4, in which said grooves are arcuate and are located on the leading and trailing surfaces of said ironing die.

6. An ironing process as defined in claim 5, in which adjacent grooves on said leading and trailing surfaces of said die are interconnected along a peripheral surface of said ironing die to produce a plurality of sets of grooves.

7. An ironing process as defined in claim 6, in which liquid is simultaneously supplied to each set of grooves adjacent a corner of said die between the leading edge and the peripheral surface.

8. An ironing process as defined in claim 3, the further step of maintaining said liquid at a temperature below the initial ambient temperature of said cup.

9. An ironing process as defined in claim 1, in which said fluid medium is water, including the further step of maintaining said water at a substantially constant temperature above 150° F.

10. An ironing process as defined in claim 3, in which said ironing die has a circular opening therein, and in which said liquid is directed to said opening in a non-radial path with respect to the center of said opening.

11. In a method of converting a shallow metal cup into a container having a cylindrical sidewall and an integral end wall with a circular punch and at least one ironing die having a circular opening cooperating with the punch to reduce the wall thickness of said cup, comprising the steps of placing said cup in alignment with said punch and moving said punch axially of said cup and said at least one ironing die to force said cup through said at least one ironing die, the improvement comprising flowing a heated fluid medium through said punch to maintain the body of said punch a predetermined temperature above the initial ambient temperature of said cup.

12. A method as defined in claim 11, in which said fluid medium is water and said water is maintained at a substantially constant temperature above 130° F.

13. A method as defind in claim 11, further including flowing a liquid in a non-radial path with respect to the center of said opening along at least a leading surface of said ironing die and maintaining a temperature for said liquid which is less than said predetermined temperature.

14. A method as defined in claim 13, in which said liquid is maintained at a temperature below the initial ambient temperature of said cup.

15. A method as defind in claim 14, in which said at least one ironing die includes a tungsten carbide ring and said ring has grooves in the leading and trailing surfaces which extend perpendicular to the axis of said opening for receiving said liquid and in which said grooves are arranged so that said liquid flows around the peripheral surface of said cup as it exits from said grooves.

16. In a method of producing an ironed container from a metal cup with a circular punch and at least one axially aligned ironing die having a circular opening with a supporting member surrounding and supporting said ironing die, comprising the steps of placing said cup in alignment with said punch and said ironing die, and moving said punch and ironing die relative to each other to force said cup through said opening and reduce the sidewall thickness thereof, the improvement of producing a liquid coolant flow channel in said support member and in communication with at least one surface of said ironing die, delivering a liquid coolant into said channel and directing said liquid across at least one surface of said die and along a path which is non-radial with respect to said opening so that said liquid coolant has a tangential component of flow with respect to a peripheral surface of said cup in said opening and said liquid coolant flows around the peripheral surface of said cup.

17. A method as defined in claim 16, in which said ironing ring includes a tungsten carbide ring and said ring has leading and trailing surfaces extending substantially perpendicular to the axis of said opening with each of said surfaces having grooves defined therein which define said path for said liquid coolant.

18. A method as defined in claim 17, in which said grooves are arcuate having centers offset from the center of said opening and in which each groove on said leading surface is in communication with a groove on said trailing surface through a further groove on a peripheral surface of said ring to define a plurality of sets of grooves, and in which said liquid coolant is simultaneously delivered to all of said sets of grooves from said flow channel.

19. A method as defined in claim 16, in which said liquid coolant is maintained at a substantially constant temperature less than the initial ambient temperature of said cup.

20. A method as defined in claim 19, further including flowing a fluid medium through said punch and maintaining the temperature of said fluid medium above the initial ambient temperature of said cup.

21. An ironing ring for use with a punch to iron a sidewall of a metal cup comprising a tungsten carbide body having a circular opening with leading and trailing surfaces extending substantially perpendicular to the axis of said circular opening, the improvement of said leading and trailing surfaces each having a plurality of grooves extending from the periphery of said member to said opening for receiving a liquid to transfer heat from said body to said liquid during an ironing process, said grooves being positioned non-radially with respect to said axis so that the liquid will have a tangential component of flow with respect to said opening.

22. An ironing ring as defined in claim 21, in which each of said grooves is arcuate and each of said arcuate grooves has a radial center which is offset from said axis.

23. An ironing ring as defined in claim 22, in which said body has a circular peripheral surface and said peripheral surface has a plurality of grooves each connecting a groove in said leading surface with a groove in said trailing surface to define a plurality of sets of grooves.

24. An ironing ring as defined in claim 23, in which the grooves in the respective leading and trailing surfaces of each set of grooves are circumferentially offset from each other.

* * * * *